United States Patent [19]

Takagi et al.

[11] Patent Number: 4,614,103

[45] Date of Patent: Sep. 30, 1986

[54] ROLLING MILL

[75] Inventors: Michimasa Takagi; Toshiyuki Kajiwara; Takao Sakanaka, all of Hitachi, Japan

[73] Assignee: Hitachi, Ltd., Tokyo, Japan

[21] Appl. No.: 687,255

[22] Filed: Dec. 28, 1984

[30] Foreign Application Priority Data

Dec. 29, 1983 [JP] Japan ..... 58-247684

[51] Int. Cl.[4] ..... B21B 13/14; B21B 29/00

[52] U.S. Cl. ..... 72/242; 72/245

[58] Field of Search ..... 72/241, 242, 243, 245, 72/450

[56] References Cited

U.S. PATENT DOCUMENTS

| | | | |
|---|---|---|---|
| 2,927,489 | 3/1960 | Teutsch | 72/243 |
| 3,003,373 | 10/1961 | Volkheusen | 72/243 |
| 3,533,263 | 10/1970 | Wochnik et al. | 72/243 |
| 3,603,125 | 9/1971 | Edwards | 72/21 |
| 4,270,377 | 6/1981 | Verbickas et al. | 72/242 |
| 4,369,646 | 1/1983 | Kajiwara | 72/243 |
| 4,494,396 | 1/1985 | Iwanami et al. | 72/245 |
| 4,499,748 | 2/1985 | Nihei et al. | 72/243 |

*Primary Examiner*—Francis S. Husar

*Assistant Examiner*—Jorji M. Griffin

*Attorney, Agent, or Firm*—Beall Law Offices

[57] ABSTRACT

Horizontal supporting rolls disposed at a lateral side of the work rolls support the work rolls in the direction of travel of the rolled material, and horizontal back-up rolls disposed at a lateral side of the horizontal supporting rolls back-up the horizontal supporting rolls. Frames rotatably hold the horizontal supporting rolls and the horizontal back-up rolls at both axial ends of these rolls, and a first driving mechanism causes a movement of the frames in the direction of travel of the material to be rolled and to impart to the work rolls desired pressing force acting in the direction of travel of the rolled material. A second driving mechanism restrains the position of the frames thus setting the work rolls at predetermined offset positions, provided on the face of the housing confronting the holding means and adapted to guide the movement of the holding member in the direction of travel of the rolled material. With this arrangement, it is possible to prevent any horizontal deflection of the work roll thus affording a highly precise crown and shape control on the rolled product, while facilitating the setting of the work rolls at a designated offset position, as well as replacement of the work rolls.

16 Claims, 9 Drawing Figures

ROLLING MILL

BACKGROUND OF THE INVENTION

The present invention relates to a multi-stage rolling mill having work rolls of a small diameter and supporting rolls for supporting and driving the work rolls.

In order to roll thin or hard material smoothly while meeting the demand for saving energy used in driving the rolling mill, a rolling mill has been proposed in which small-diameter work rolls having bending means are combined with axially shiftable intermediate rolls with bending means and back-up rolls. Such a rolling mill is disclosed, for example, in the specification of the U.S. Pat. No. 4369646 (Japanese Patent Laid-Open Publication No. 66307/1981).

When work rolls of small diameter are used for smooth rolling of hard and thin material such as stainless steel sheet, it is not possible to directly transmit the driving torque to the work rolls due to restrictions in terms of mechanical strength. In such a rolling mill, therefore, the driving torque is transmitted to the intermediate rolls which in turn transmit the driving torque to the small work rolls thus effecting the rolling. In this case, since the intermediate rolls are driven in the direction counter to the small work rolls, the small work rolls are urged by a horizontal force $F_H$ in the direction opposite to the direction of running of the rolled material, due to the friction between the intermediate rolls and the small work rolls and the friction between the small work rolls and the rolled material. This horizontal force $F_H$ tends to deflect the small work roll horizontally towards the material inlet side of the rolling mill, which in turn causes marks known as "Herringbone marks" to appear on the surface of the rolled material. This inconveniently degrades the quality of the rolled product and impairs the shape of the same.

Various proposals have been made to overcome this problem. For instance, it has been proposed to support the work roll surface both from the material inlet and outlet sides such as to prevent deflection of the small work rolls towards the material inlet side. According to another proposal, the work roll surface is supported from the material outlet side and, at the same time, the work roll is positively displaced at suitable points selected along the axis such as to effect a shape control of the rolling.

These methods, however, cannot perfectly prevent the deflection of the small work rolls stably, and cannot satisfactorily meet the demand for both the smooth rolling of harder material into smaller thicknesses and the saving of driving energy.

More specifically, the method in which the small work roll is supported both from the material inlet and outlet sides, disclosed in the specification of the U.S. Pat. No. 4270377 (Japanese Patent Laid-Open Publication No. 30390/1980), employs horizontal support rolls for horizontally supporting the work roll. The horizontal supporting rolls are carried by respective frames the positions of which are adjustable through rotation of the adjusting screws. Such an arrangement is quite unsuitable for quick positioning of the horizontal supporting rolls. In addition, the positioning of the small work roll correctly at the position for preventing the horizontal bending of the small work rolls is difficult because of the presence of play between the adjusting screws and the frame. In addition, this method is inconvenient from the view point of easiness of roll replacement which is often essentially conducted in rolling mills. The replacement of the work rolls requires a working space around the work roll. When horizontal supporting rolls are used, therefore, it is necessary to quickly move these horizontal work rolls out of contact with the work roll to afford such working space. In the known system of the type described, the movement of the horizontal suporting rolls is possible only through the operation of the adjusting screw as in the case of the positioning of the horizontal supporting rolls. Consequently, much labour and time are required for the roll replacement, resulting in a lower rate of operation of the rolling mill. In the case where chocks having a roll bending means are used in combination with the work rolls, the above-mentioned working space has to be considerably large in order to accommodate not only the work rolls pulled out from the working position but also the chocks which have a size much greater than that of the work roll. With the above-explained known system, lacking such a large working space, it is totally impossible to replace the work roll combined with a roll bending means carried by a large chock.

SUMMARY OF THE INVENTION

Accordingly, an object of the invention is to provide a rolling mill which can effectively prevent the bending of the work rolls in the direction of the rolling path and which can permit a quick and precise setting of the work rolls in the designated offset position, while facilitating the work involved in replacement of the work rolls.

To these ends, according to the invention, there is provided a rolling mill of the type having a housing, an upper work roll and a lower work roll adapted to cooperate in rolling a material therebetween, supporting rolls disposed at the upper and lower sides of the upper and lower work rolls such as to vertically support and drive the work rolls, horizontal suporting rolls disposed at a lateral side of the work rolls so as to support the work rolls from the lateral side in the direction of path of the material being rolled, and horizontal back-up rolls disposed at a lateral side of the horizontal supporting rolls so as to back-up the horizontal supporting rolls, the rolling mill comprising: a holding means for rotatably holding the horizontal supporting rolls and the horizontal back-up rolls at both axial ends of these rolls; a first driving means provided on the housing and mechanically connected to the holding means, the first driving means being adapted to cause a movement of the holding means in the direction of the path of movement of the material to be rolled and to impart to the work rolls desired pressing force acting in the direction of the path of the rolled material; a second driving means provided on the housing and adapted to be engaged with a restraining means for restraining the position of the holding means such as to move the holding means through the restraining means thus setting the work rolls at predetermined offset positions; and a guide means provided on the face of the housing confronting the holding means and adapted to guide the movement of the holding means in the direction of path of the material being rolled.

These and other objects, features and advantages of the invention will become clear from the following description of the preferred embodiment when the same is read in conjunction with the accompanying drawings.

DESCRIPTION OF THE PREFERRED EMBODIMENTS

Figure 1:
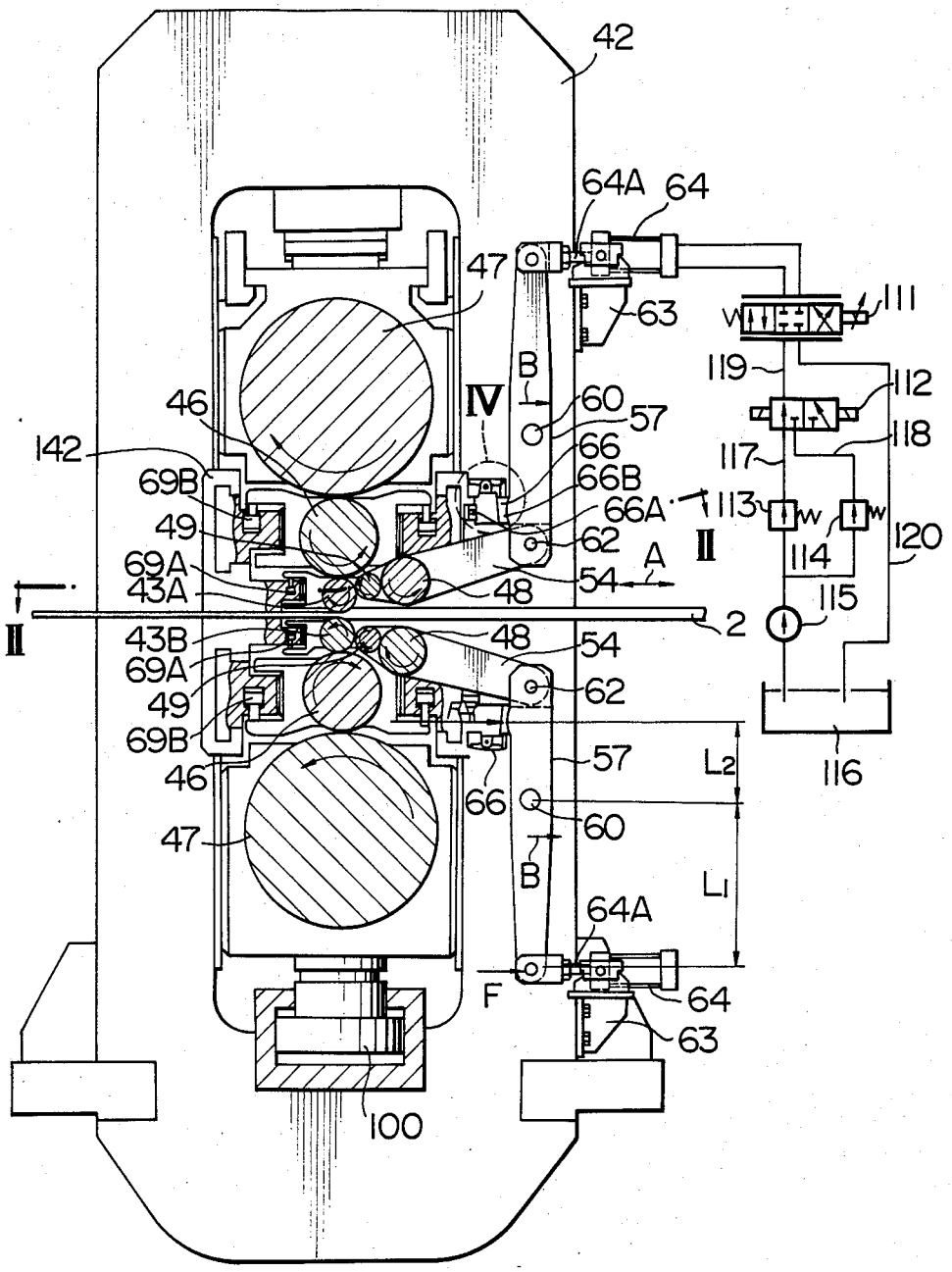
FIG. 1 is a side elevational view of a 6-stage rolling mill in accordance with an embodiment of the invention, having a horizontal supporting mechanism for a small work roll.

Preferred embodiments of the invention will be described hereinunder with reference to the accompanying drawings.

Referring to FIGS. 1 to 4, a pair of small work rolls 43 opposing each other in the vertical direction are adapted to roll a material 2 therebetween. Each work roll 43 is supported at both its axial ends by bearings 44A held by metal chocks 44 mounted in a housing 42.

The upper work roll 43A supported vertically from the upper side by an upper intermediate roll 46 which is in this case a driving roll and movable in the axial direction, and an upper back-up roll 47 contacting the upper intermediate roll 46. The lower work roll 43B is supported vertically from the lower side by a lower intermediate roll 46 and a lower back-up roll 47 similar to those for the upper work roll 43B. The intermediate rolls 46 and the back-up rolls 47 are intended for transmitting the rolling load from a roll reduction device 100 to the work rolls 43A and 43B. Roll bending devices 69A, 69B housed by project blocks 142 on the housing 42 are adapted to apply vertical forces to the axial ends of the intermediate rolls 46 and the work rolls 43 thus imparting roll bending force to these rolls.

At the material inlet side of each work roll 43, i.e., at the right side of the same as viewed in FIG. 1, there is provided a horizontal supporting roll 49 supporting the work roll from the material inlet side such as to prevent horizontal deflection of the work roll 43 towards the inlet side. Both axial ends of the horizontal supporting roll 49 are supported through bearings 52 on bearing boxes 53 which are carried by frames or arms 54 connected to each other through a separator 54A. The arrangement is such that the bearing boxes 53 are movable back and forth with respect to the arms 54 along the path of the material to be rolled.

A reference numeral 48 designates a horizontal back-up roll for supporting each horizontal supporting roll 49 in contact therewith. This roll is carried by the arms 54 through bearings 55. The horizontal back-up rolls 48 and the horizontal supporting rolls 49 have effective lengths which are greater than the maximum breadth of the rolled material in order to prevent an edge mark from being impressed on the rolled product.

Figure 2:
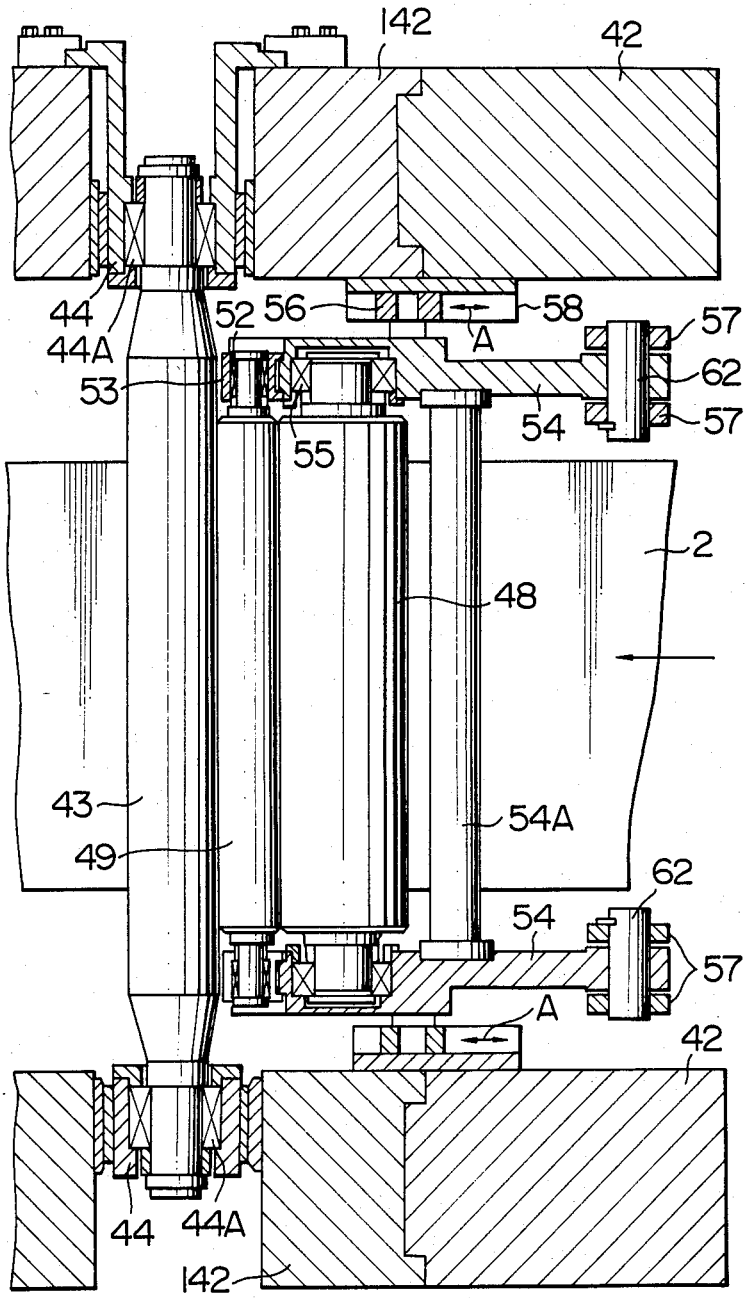
FIG. 2 is a sectional view taken along the line II—II of FIG. 1.
Figure 3:
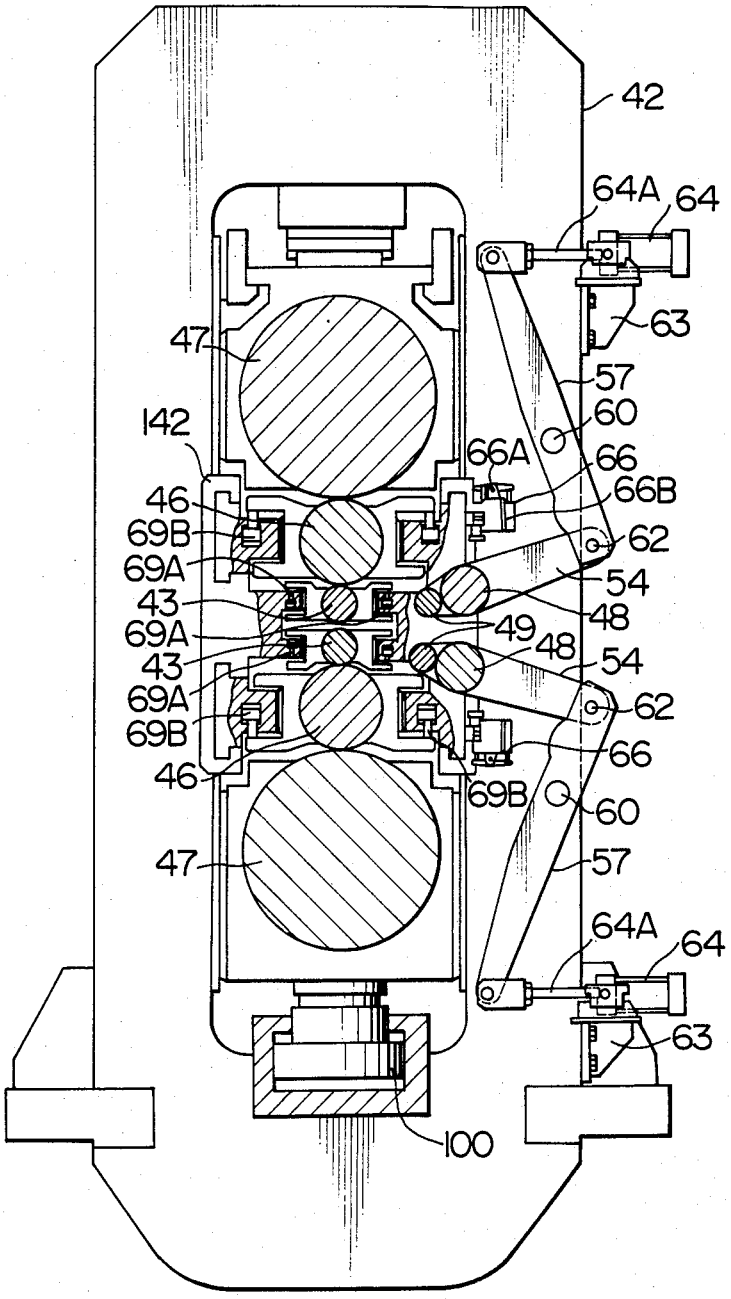
FIG. 3 is a side elevational view of the 6-stage rolling mill shown in FIG. 1 with the horizontal supporting mechanism moved apart from the small work roll.

The frames 54 to which the horizontal supporting roll 49 and the horizontal back-up roll 48 are secured are provided with wheels 56 so that they can move in the direction of the path of the rolled material indicated by an arrow A in FIGS. 1 and 2, along guide rails 58 which are laid on the housing 42.

Horizontal shafts 60 are secured to the housing 42 so as to extend in parallel with the horizontal supporting rolls 49 at positions above and below the rolling path at the material inlet side of the rolling mill. These horizontal shafts pivotally support vertical arms 57. These vertical arms 57 are pivotally connected to the frames 54 by means of pivot pins 62, while the other ends of the arms 57 are connected to cylinder rods 64A of hydraulic cylinders 64 which are mounted on the housing 42 through brackets 63. The arrangement is such that, as the hydraulic cylinders 64 operate, the vertical arms 57 rock around the shafts 60 so that the frames 54 carrying the horizontal supporting rolls 49 are moved in the direction of the arrow A.

Figure 4:
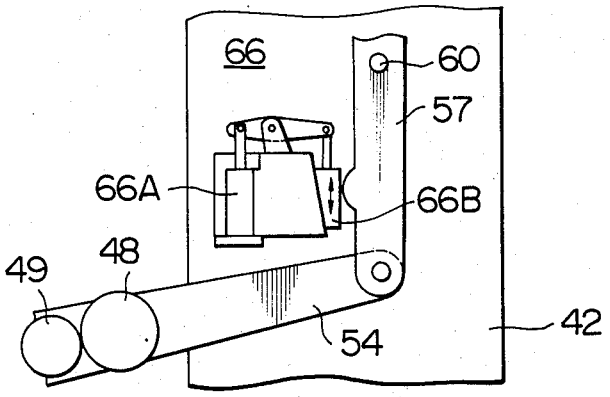
FIG. 4 is an enlarged view of a portion marked by IV in FIG. 1.

Referring to FIG. 4 showing a part of the rolling mill drawn to a larger scale, the housing 42 carries taper wedge devices 66 adapted to be contacted by the vertical arms 57 thus limiting the swinging stroke of the arms 57, and thereby locating the horizontal supporting rolls. Each taper wedge device 66 has a hydraulic cylinder 66A which is adapted to slidingly drive a wedge 66B to adjust the amount of projection of the wedge 66B towards the vertical arm 57, thus allowing an adjustment of the position of the frames 54, i.e., the distance between the horizontal supporting roll 49 and each work roll 43.

This arrangement permits a precise positioning of the work rolls at such positions that the axes of the work rolls 43 are offset from the vertical plane through the axes of the intermediate rolls 46 in the direction of the rolling path. After setting the offset of the work roll 43, the hydraulic cylinder 64 is operated with a working fluid of a high pressure so as to swing the vertical arm 57 in the direction of the arrow B in FIG. 1, thereby horizontally prestressing the work roll 43 through the horizontal supporting roll 49.

The level of the pre-stress is equal to the reactional force R ($R=L_1/L_2F$) acting on the taper wedge device 66, F representing the force produced by the hydraulic cylinder 64, the $L_1$ distance between the hydraulic cylinder 64 and the fulcrum (shaft 60) of the vertical arm 57 serving as a lever and $L_2$ the distance between the fulcrum and the taper wedge device 66. Consequently, this pre-stress is born and stored by the vertical arm 57.

The storage of the pre-stress in the vertical arm 57 offers the following advantages. Namely, in operation, the aforementioned horizontal force $F_H$ which tends to deflect the work roll 43 in the direction of rolling path as a result of the driving by the intermediate roll, as well as a horizontal component $F_R$ of the rolling load imposed by the roll reduction device 100 due to offsetting of the work roll 43, is brought to bear on the work roll 43. However, since the horizontal supporting roll 49 held on the frame 54 is supported by the pre-stress existing in the vertical arms 57 operated by the hydraulic cylinder 64, the small work roll 43 is never deflected in the horizontal direction, even during acceleration and deceleration at which time such deflection is most liable to take place. It will be understood that a large prestress can be imparted to the vertical arms 57 by means of a comparatively small amount of power from the hydraulic cylinders 64 by increasing the lever ratio $L_1/L_2$.

For replacing each work roll 43, it is necessary to withdraw the work roll 43 together with the metal chocks 44 on both ends of the work roll 43 out of the rolling stand and to move a new work roll into the rolling stand. To this end, a sufficiently large working space has to be provided around the work roll 43 on the rolling stand. This can be attained by operating the hydraulic cylinders 64 such as to drive the frames 54 along the guide rails 58 away from the work roll 43 through the action of the vertical arms 57, thereby forming the required working space for the roll replacement between the work roll and the horizontal supporting roll 49 supported by the frames 54.

Thus, the application of the pre-stress for preventing the horizontal deflection of the work roll 43, as well as the movement of the frames 54 carrying the horizontal supporting roll 49 along the rolling path for the purpose of roll replacement, is conducted by the hydraulic cylinders 64. The hydraulic system for operating each hydraulic cylinder 64 is as follows.

Referring to FIG. 1, the hydraulic cylinder 64 is adapted to be supplied with oil which is sucked up from a tank 116 by a pump 115. The hydraulic line leading from the discharge side of the hydraulic pump 115 is divided into two sub-lines: namely, a low-pressure line 117 having a low-pressure regulating valve 113 and a high-pressure line 118 having a high-pressure regulating valve 114. The low-pressure line 117 and the high-pressure line 118 are connected to a change-over valve 112 which in turn is connected through a pipe 119 to the hydraulic cylinder 64 past another change-over valve 111. On the other hand, the oil discharged from the hydraulic cylinder 64 is returned to the tank 116 through the change-over valve 111 and a pipe 120.

For preventing the horizontal deflection of the work roll, this hydraulic system operates in the manner explained hereinunder.

First of all, the change-over valves 112 and 111 are operated such as to supply the oil to the hydraulic cylinder 64 through the low-pressure line 117, so that the vertical arms 57 are actuated to move the frames 54 and, hence, the horizontal supporting roll 49 in the direction of travel of the rolled material until the horizontal supporting roll 49 is pressed lightly onto the surface of the work roll 43, thus eliminating any play within the lever link mechanism composed of the frames 54 and the vertical arms 57.

Then, pressurized oil is supplied to the hydraulic cylinder 66A of the taper wedge device 66 from a hydraulic system which is not shown, thereby moving the wedge 66B of this device 66 up and down such as to move the vertical arms 57 and the frames 54 so that the horizontal supporting roll 49 is moved with the work roll 43 in contact therewith, until the work roll 43 is correctly set at the designated offset position. After positioning the horizontal supporting roll 49 in the manner described, the change-over valve 112 is operated to introduce the pressurized oil to the hydraulic cylinder 64 through the high-pressure line 118, so as to produce the pre-stress to be applied to the work roll 43, thus completing the setting of the horizontal supporting roll 49.

In the case where the rolling mill is intended for a reversible rolling, the lever ratio of the vertical arms 57 and the hydraulic pressure of the high-pressure line for supplying high-pressure oil to the hydraulic cylinder 64 should be determined such as to be able to produce a pre-stress large enough to overcome the sum of (1) horizontal component $F_R$ of the rolling load produced due to offsetting of the work roll and (2) horizontal bending force $F_H$ acting on the work roll due to tangential force applied as a result of driving by the intermediate roll, because these horizontal forces act in the same direction when the rolling mill is reversed.

As will be understood from the foregoing description, in the embodiment of the rolling mill described hereinbefore, the roll surface of the work roll 43 is supported from the material inlet side by the horizontal supporting roll 49 and the horizontal back-up roll 48, and a pre-stress acting in the direction of movement of the rolled material is applied in the vertical arms 57 connected to the frames 54 supporting the shaft of the horizontal back-up roll 48. It is, therefore, possible to prevent, with quite a simple arrangement, the deflection of the work roll 43 towards the material inlet side without fail.

It is to be noted also that the setting of the work roll 43 at the offset position can be made quickly and precisely, partly because the mechanical means for moving the horizontal suporting roll 49 in the direction of path of the rolled material, constituted by the hydraulic cylinders 64, vertical arms 57, frames 54 and the taper wedge device 66, is so constructed as to be able to eliminate any play and because the horizontal supporting roll 49 can move over a considerably large stroke. Consequently, the work roll 43 is precisely supported in the horizontal direction by the horizontal work roll 49, thus allowing a high precision of the crown control of hard and thin products rolled by the rolling mill.

In general, in the rolling mill of the type described, it is necessary to preserve an ample space at the inlet section 70 for the rolled material 2, in order to permit smooth operation and maintenance. This requirement is fully met by the invention as will be understood from the following explanation. Namely, in the described embodiment, the horizontal supporting rolls 49 are carried by link mechanisms including frames 54 carrying the horizontal supporting rolls 49 and arranged to diverge upwardly and downwardly towards the upstream end, i.e., the rolled material inlet side, and vertical arms 57 connected to the frames and rockable around shafts 60 which are parallel to the horizontal supporting rolls 49. The link mechanisms are adapted to be actuated by hydraulic cylinders 64 disposed, respectively, at upper and lower portions of the housing 42. It is, therefore, possible to preserve a large space at the material inlet section 70.

The work rolls 43, horizontal supporting rolls 49 and the horizontal back-up rolls 48 have effective roll lengths which are greater than the maximum breadth of the material 2 to be rolled, so that there is no fear of transfer of an edge mark to the rolled material.

Preferably, the hardness $H_W$ of the roll surface of the work roll 43, hardness $H_{SU}$ of the rolling surface of the horizontal supporting roll 49 and the hardness $H_B$ of the rolling surface of the horizontal back-up roll 48 are so selected as to meet the condition of: $H_W > H_{SU} > H_B$. This will perfectly eliminate the transfer of an edge mark to the rolled material 2. In such a case, the difference in hardness between adjacent rolls preferably ranges between 10 and 20 $H_S$ in terms of Shore hardness.

Furthermore, since the horizontal supporting rolls 49 carried by the frame 54 are adapted to be driven in the direction of the travel of the rolled material by the operation of the hydraulic cylinders 64 and the taper wedge devices 66, the horizontal supporting rolls 49 can be moved quickly to positions where they do not hinder the work involved in replacing the work rolls 43, thus forming quickly the working space for the replacement of the work rolls.

Although in the described embodiment the vertical arms 57 are swung by means of hydraulic cylinders 64, it is to be noted that the use of the hydraulic cylinders are not exclusive and other suitable driving means such as worm jacks may be used provided that such driving means can apply a predetermined load to the vertical arms 57.

It is also possible to use, in place of the taper wedge devices 66 for locating the horizontal supporting rolls, a suitable mechanical stop means such as a cam capable of stopping the vertical arms and allowing a slight adjustment of rotational position of the vertical arms.

Another embodiment of the rolling mill of the invention will be described hereinunder with specific reference to FIGS. 5 to 7. Most parts of this embodiment are identical or similar to those of the first embodiment, so that the description will be focussed mainly on the points of difference.

Figure 6:
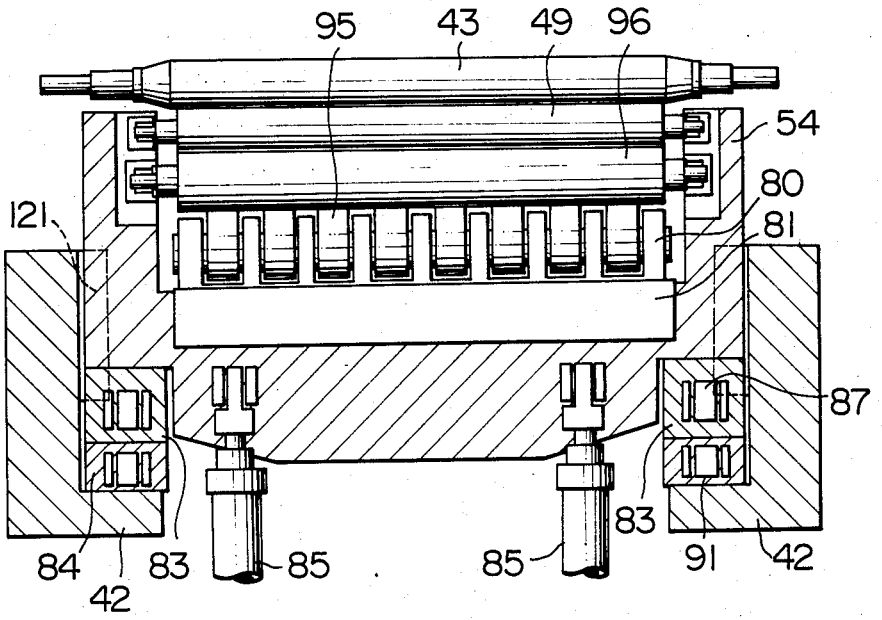
FIG. 6 is a sectional view taken along the line VI—VI of FIG. 5.
Figure 5:
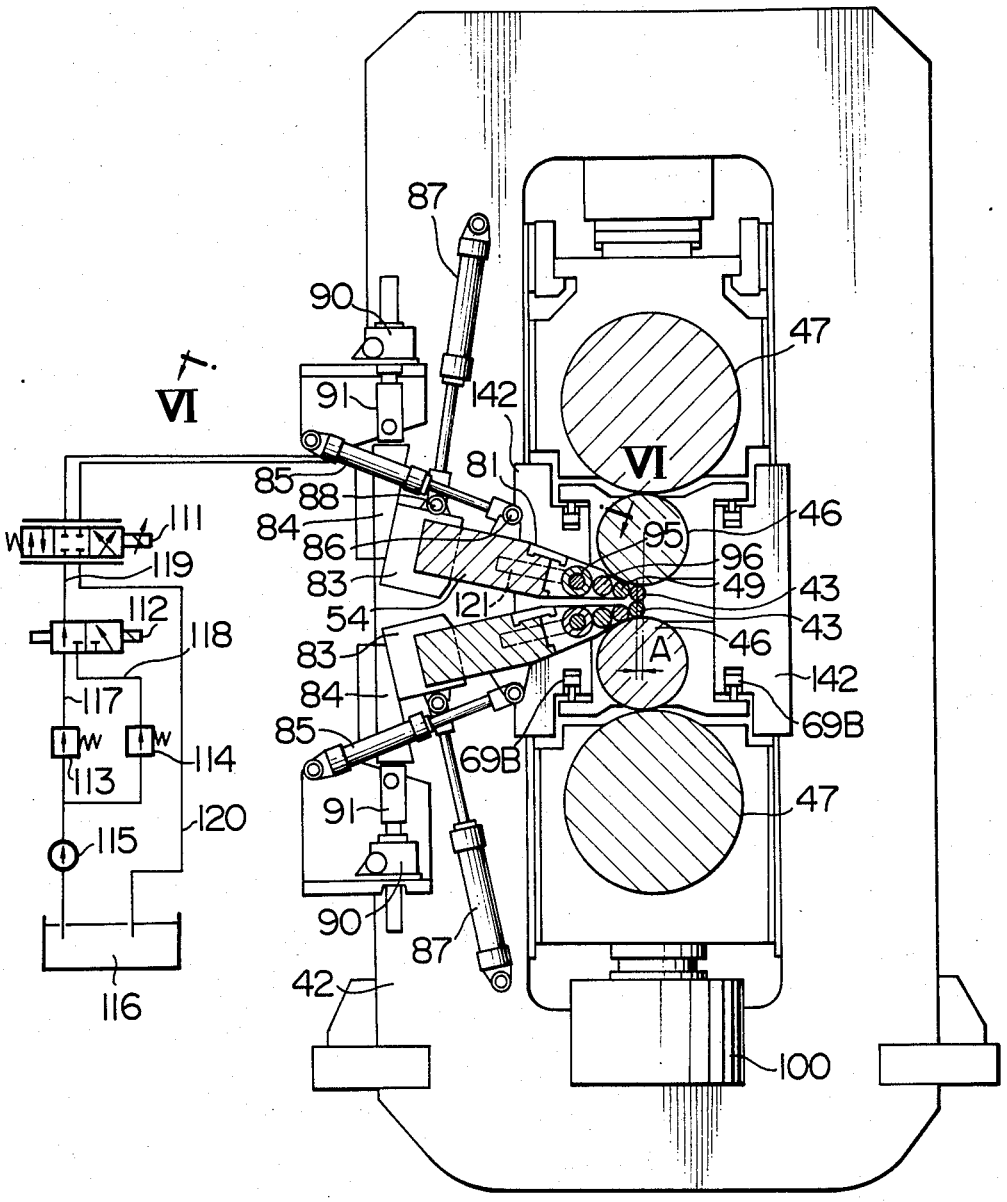
FIG. 5 is a side elevational view of a 6-stage rolling mill in accordance with another embodiment of the invention, with a horizontal supporting mechanism for the small work roll.
Figure 7:
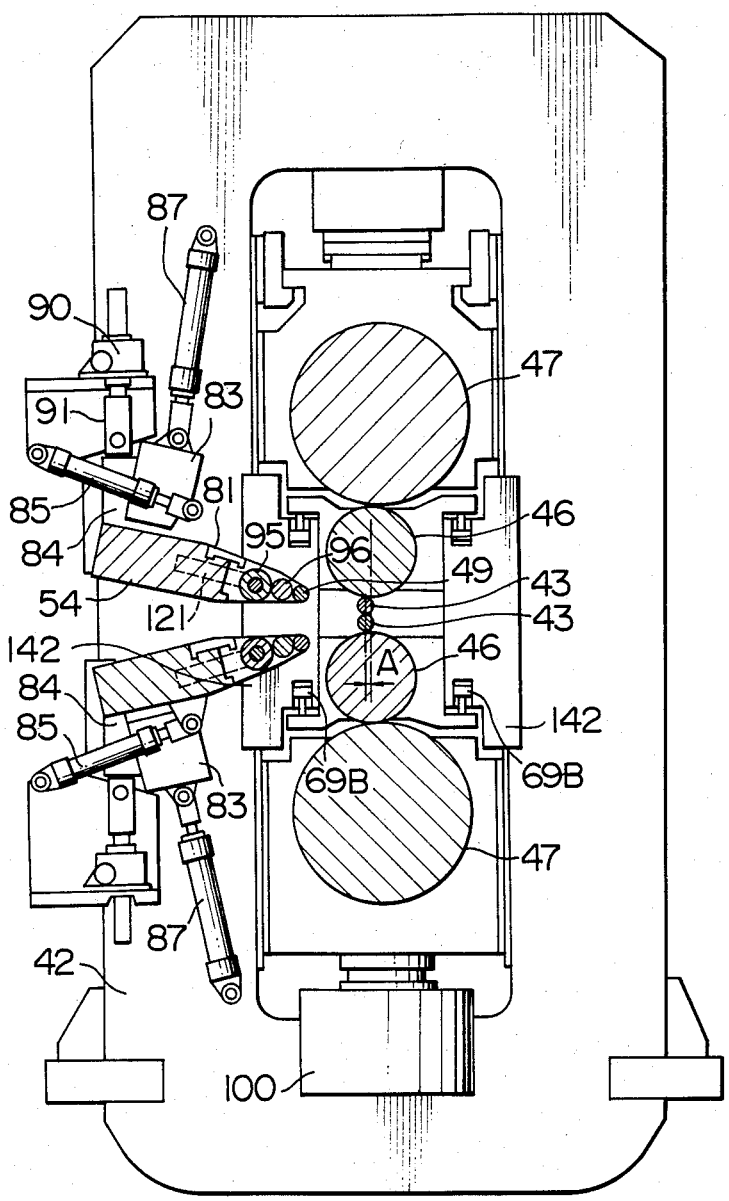
FIG. 7 is a side elevational view of the 6-stage rolling mill shown in FIG. 5, with the horizontal supporting mechanism moved apart from the small work roll.

Referring to FIGS. 5 to 7, a rolling mill of the second embodiment has small work rolls 43 the axes of which are offset by an amount "A" from the plane of the axes of intermediate rolls 46 in the direction of travel of the rolled material. Usually, the amount of offset is selected to fall between 5 and 10% of the distance between the axes of the work roll and the intermediate roll.

In operation of this rolling mill, each work roll 43 is subjected to horizontal component $F_R$ of the rolling load exerted by the rolling reduction device 100 and a horizontal bending force $F_H$ which is the tangential force exerted by the intermediate roll serving as the driving roll. These forces are born by horizontal back-up roll 95 through a first horizontal supporting roll 49 and a second horizontal supporting roll 96 which are carried by the frame 54. This back-up roll 95 is divided in the axial direction into a plurality of segments. All segments of the back-up roll 95 are secured to a block 80 and are fixed to the frame 54 by means of a plate 81. The horizontal supporting roll assembly thus constructed is held by the housing 42 through the intermediary of the wedge 84. The frame 54 carrying the horizontal supporting roll 49 and other rolls is adapted to be moved in the direction of travel of rolled material by means of a hydraulic cylinder 85 mounted on the housing 42 and acting through a pivotal connection 86. The hydraulic cylinder 85 is actuated by a hydraulic system which is materially identical to that of the first embodiment explained in connection with FIG. 1. The setting of the offset of the work roll 43 is performed by means of a wedge 84 which is adapted to be moved up and down through a spindle 91 by means of a worm jack 90 secured to the housing 42.

The hydraulic cylinder 85 is operated by the hydraulic oil supplied through the low-pressure line until the horizontal supporting roll 49 comes into contact with the work roll 43 thus eliminating any play. Then, the worm jack 90 is operated to move the wedge 84 up and down, thus correctly setting the work roll 43 at the designated offset position. After setting the work roll 43 at the designated offset position, the hydraulic cylinder 85 is operated by the hydraulic pressure supplied through the high-pressure line, thereby imparting the desired prestress to the work roll 43 through the frame 54 and the horizontal supporting roll 49. Furthermore, in order to facilitate the replacement of the work rolls 43, a spacer block 83 is adapted to be moved into and out of the space between the wedge 84 and the frame 54 by means of a hydraulic cylinder 87 provided on the housing 42 and acting through pivotal connection 88. The movement of the frames 54 is guided by guides 121 provided on the housing 42.

The operation of this second embodiment will be described hereinunder.

As the first step of the operation, the setting of each work roll 43 at the designated offset position is conducted in the following manner.

The change-over valves 111 and 112 are operated such that pressurized oil is supplied to the hydraulic cylinder 85 through the low-pressure line 117, so that the frames 54 carrying the horizontal supporting roll 49 are moved towards the housing 42 until the frames 54 lightly contact the housing 42 through the intermediary of the spacer block 83 and the wedge 84, thus eliminating mechanical play between the parts incorporated. Subsequently, the upper and lower work rolls 43 are loaded by the rolling reduction device 100 through the intermediate rolls 46 and the back-up rolls 47, thereby to apply to the work rolls 43 horizontal force components which act to urge the work rolls 43 towards the horizontal supporting rolls 49. Then, a worm jack 90 is driven by an electric motor not shown to move the wedge 84 up and down through the action of the spindle 91, thereby correctly setting each work roll 43 at the designated offset position. Thereafter, the change over valve 112 of the pressurized oil line is operated to allow the supply of the pressurized oil to the hydraulic cylinder 85 through the high-pressure line 118, thus applying horizontal pre-stress to the work roll 43 through the horizontal supporting roll 49. Needless to say, this prestress is selected to be large enough to overcome the sum of the horizontal component $F_R$ of the rolling load due to the offset of the work roll 43 and the horizontal bending force $F_H$ which is the tangential force produced as a result of driving by the intermediate roll 46. Therefore, the undesirable horizontal deflection of the work rolls 43 is avoided during the rolling and the crown control and shape control of the rolled material can be achieved at a high precision by a suitable combination of the axial shift of the intermediate rolls, bending of the intermediate rolls and the bending of the work rolls.

For affording a suitable working space around the work rolls for the purpose of replacement or maintenance of the work rolls, the hydraulic cylinders 87 are operated to withdraw the spacer blocks 83 from the space between wedges 84 and the frames 54 as shown in FIG. 7, and the frames 54 are retracted along the guides 121 into the spaces which have been occupied by the spacer blocks 83, by supplying pressurized oil to the hydraulic cylinders 85 through the low-pressure lines 117. In this state, a space large enough to permit the withdrawal and installation of old and new work rolls is preserved thus facilitating the replacement of the work rolls.

Preferably, a hardness difference of 10 to 20 $H_S$ in terms of Shore hardness is provided between the adjacent rolls such as to meet the condition of $H_W > H_{SU1} > H_{SU2} > H_B$, where, $H_W$, $H_{SU1}$, $H_{SU2}$ and $H_B$ represent the rolling surface hardnesses of the work roll 43, first horizontal supporting roll 49, second horizontal supporting roll 96 and the horizontal back-up roll 95. With such an arrangement, it is possible to avoid the transfer of an edge mark to the rolled product.

Figure 8:
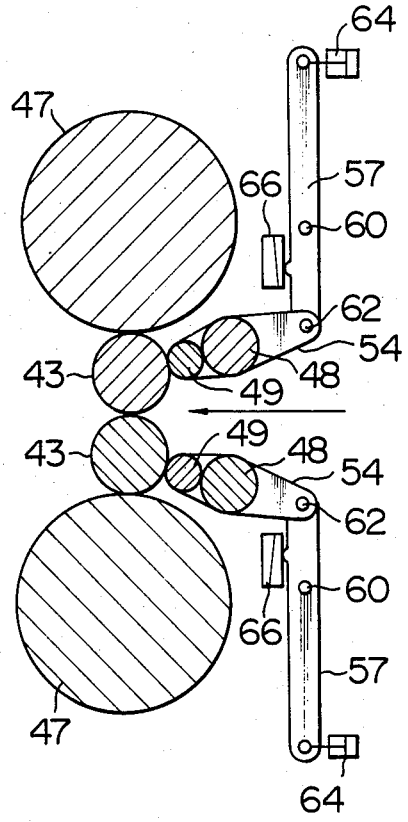
FIGS. 8 and 9 are schematic illustrations of 4-stage and 5-stage rolling mills incorporating a horizontal supporting mechanism of the same type as that shown in FIG. 1.
Figure 9:
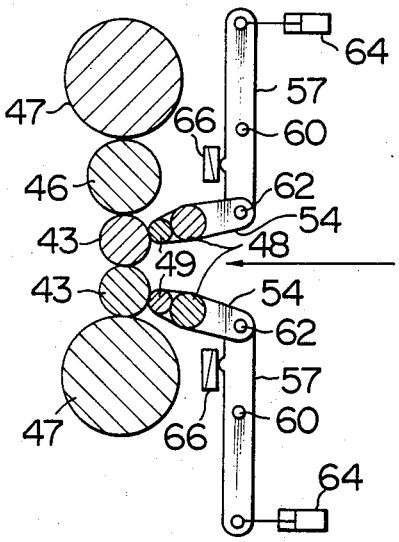

FIGS. 8 and 9 schematically show a four-stage rolling mill and a five-stage rolling mill incorporating a horizontal supporting unit of the same construction as that used in the first embodiment shown in FIGS. 1 to 4.

Although not shown, the four-stage rolling mill and the five-stage rolling mill shown in these Figures may incorporate a horizontal roll supporting units of the same type as that in the second embodiment shown in FIGS. 5 to 7, in place of that shown in FIGS. 1 to 4.

From FIGS. 8 and 9, it will be understood that the first and second embodiments can equally be applied to various types of multi-stage rolling mills.

As has been described, according to the invention, it is possible to effectively prevent the bending of the work rolls in the direction of path of the rolled material and also to quickly and precisely set the work rolls at the designated offset position. In addition, the work involved in replacement of the work rolls is facilitated considerably.

What is claimed is:

1. A rolling mill of the type having a housing, an upper work roll and a lower work roll adapted to cooperate in rolling a material therebetween, a supporting rolls disposed at the upper and lower sides of said upper and lower work rolls such as to vertically support and drive said work rolls, horizontal supporting rolls disposed at a lateral side of said work rolls so as to support said work rolls from the lateral side in the direction of path of the rolled material, and horizontal back-up rolls disposed at a lateral side of said horizontal supporting rolls so as to back up said horizontal supporting rolls, said rolling mill comprising:

a pair of holding members respectively rotatably holding opposite ends of said horizontal supporting rolls and rotatably holding opposite ends of said horizontal back-up rolls;

a first driving means provided on said housing and mechanically connected to said pair of holding members, said first driving means being adapted to cause a movement of said holding members in the direction of the path of movement of the material to be rolled and to impart to said work rolls desired pressing force acting in the direction of the path of the rolled material;

restraining means for restraining the position of said holding members against movement by said first driving means;

a second driving means provided on said housing and adapted to engage with said restraining means such as to move said holding members through said restraining means in a direction opposite to said direction thus setting said work rolls at predetermined offset positions and keeping the position of the horizontal supporting rolls substantially unchanged even if the reaction force from the work rolls varies during the rolling operation; and a guide means provided on the face of said housing confronting said holding members and adapted to guide the movement of said holding members in the direction of the path of the rolled material.

2. A rolling mill according to claim 1, wherein the length of said horizontal supporting rolls is greater than the maximum breadth of the rolled material.

3. A rolling mill according to claim 1, wherein said work rolls have a rolling surface hardness greater than that of the rolling surface hardness of said horizontal supporting rolls.

4. A rolling mill according to claim 3, wherein said horizontal supporting rolls have a rolling surface hardness greater than that of said horizontal back-up rolls.

5. A rolling mill according to claim 1, wherein each of said horizontal back-up rolls is constituted by a first horizontal back-up roll for directly supporting said horizontal supporting roll and a second horizontal back-up roll for supporting said horizontal supporting roll through the intermediary of said first horizontal back-up roll, said second horizontal back-up roll being composed of a plurality of axial roll segments.

6. A rolling mill according to claim 1, wherein each of said supporting rolls for supporting said work rolls is constituted by an intermediate roll directly supporting said work roll and a back-up roll supporting said work roll through the intermediary of said intermediate roll, one of said intermediate roll and said back-up roll being adapted to receive the torque for driving said work roll, said intermediate roll being displaceable in the axial direction thereof.

7. A rolling mill according to claim 6, further comprising a bending means for applying a roll bending force to at least one of said intermediate roll and said work roll.

8. A rolling mill of the type having a housing, an upper work roll and a lower work roll adapted to cooperate in rolling a material therebetween, supporting rolls disposed at the upper and lower sides of said upper and lower work rolls such as to vertically support and drive said work rolls, horizontal supporting rolls disposed at a lateral side of said work rolls so as to support said work rolls from the lateral side in the direction of path of the rolled material, and horizontal back-up rolls disposed at a lateral side of said horizontal supporting rolls so as to back-up said horizontal supporting rolls, said rolling mill comprising:

a holding means for rotatably holding said horizontal supporting rolls and said horizontal back-up rolls at both axial ends of these rolls;

a first driving means provided on said housing and mechanically connected to said holding means, said first driving means being adapted to cause a movement of said holding means in the direction of the path of movement of the material to be rolled and to impart to said work rolls desired pressing force acting in the direction of the path of the rolled material;

a second driving means provided on said housing and adapted to engage with a restraining means for restraining the position of said holding means such as to move said holding means through said restraining means thus setting said work rolls at predetermined offset positions;

a guide means provided on the face of said housing confronting said holding means and adapted to guide the movement of said holding means in the direction of path of the rolled material; and said first driving means including a hydraulic cylinder device, a low-pressure hydraulic line for operating said hydraulic cylinder device so as to move said holding means, a high pressure hydraulic line for operating said hydraulic cylinder device such as to impart a desired pressing force to said work roll, and a change-over means adapted for effecting a switching-over between said low-pressure hydraulic line and said high-pressure hydraulic line.

9. A rolling mill of the type having a housing, an upper work roll and a lower work roll adapted to cooperate in rolling a material therebetween, supporting rolls disposed at the upper and lower sides of said upper and lower work rolls such as to vertically support and drive said work rolls, horizontal supporting rolls disposed at a lateral side of said work rolls so as to support said work rolls from the lateral side in the direction of path of the rolled material, and horizontal back-up rolls disposed at a laterial side of said horizontal supporting rolls so as to back-up said horizontal supporting rolls, said rolling mill comprising:

a holding means for rotatably holding said horizontal supporting rolls and said horizontal back-up rolls at both axial ends of these rolls;

a first driving means provided on said housing and mechanically connected to said holding means, said first driving means being adapted to cause a movement of said holding means in the direction of the path of movement of the material to be rolled and to impart to said work rolls desired pressing force acting in the direction of the path of the rolled material;

a second driving means provided on said housing and adapted to be connected to a restraining means for restraining the position of said holding means such as to move said holding means through said restraining means thus setting said work rolls at predetermined offset positions;

a spacer means adapted to be moved into and out of the space between said holding means and said restraining means so as to provide, as required, the working space necessary for the replacement of said work rolls;

a third driving means provided on said frame and connected to said spacer means so as to be able to drive said spacer means; and a guide means provided on the face of said housing confronting said holding means and adapted to guide the movement of said holding means in the direction of path of the rolled material.

10. A rolling mill according to claim 9, wherein the length of said horizontal supporting rolls is greater than the maximum breadth of the rolled material.

11. A rolling mill according to claim 9, wherein said work rolls have a rolling surface hardness greater than that of the rolling surface hardness of said horizontal supporting rolls.

12. A rolling mill according to claim 11, wherein said horizontal supporting rolls have a rolling surface hardness greater than that of said horizontal back-up rolls.

13. A rolling mill according to claim 9, wherein each of said horizontal back-up rolls is constituted by a first horizontal back-up roll for directly supporting said horizontal supporting roll and a second horizontal back-up roll for supporting said horizontal supporting roll through the intermediary of said first horizontal back-up roll, said second horizontal back-up roll being composed of a plurality of axial roll segments.

14. A rolling mill according to claim 9, wherein each of said supporting rolls for supporting said work rolls is constituted by an intermediate roll directly supporting said work roll and a back-up roll supporting said work roll through the intermediary of said intermediate roll, one of said intermediate roll and said back-up roll being adapted to receive the torque for driving said work roll, said intermediate roll being displaceable in the axial direction thereof.

15. A rolling mill according to claim 14, further comprising a bending means for applying a roll bending force to at least one of said intermediate roll and said work roll.

16. A rolling mill according to claim 9, wherein said first driving means includes a hydraulic cylinder device, a low-pressure hydraulic line for operating said hydraulic cylinder device so as to move said holding means, a high-pressure hydraulic line for operating said hydraulic cylinder device such as to impart a desired pressing force to said work roll, and a change-over means adapted for effecting a switching-over between said low-pressure hydraulic line and said high-pressure hydraulic line.

* * * * *